US009719277B2

(12) United States Patent
Brown

(10) Patent No.: US 9,719,277 B2
(45) Date of Patent: Aug. 1, 2017

(54) ELECTRICALLY OPERABLE MOTOR VEHICLE DOOR LOCK

(71) Applicant: Kiekert Aktiengesellschaft, Heiligenhaus (DE)

(72) Inventor: Scott Brown, Livonia, MI (US)

(73) Assignee: Kiekert Aktiengesellschaft, Heiligenhaus (DE)

( * ) Notice: Subject to any disclaimer, the term of this patent is extended or adjusted under 35 U.S.C. 154(b) by 487 days.

(21) Appl. No.: 13/955,586

(22) Filed: Jul. 31, 2013

(65) Prior Publication Data

US 2015/0035297 A1 Feb. 5, 2015

(51) Int. Cl.
*E05B 81/80* (2014.01)
*E05B 81/06* (2014.01)

(52) U.S. Cl.
CPC ..... *E05B 81/80* (2013.01); *E05B 81/06* (2013.01); *Y10T 292/57* (2015.04)

(58) Field of Classification Search
CPC ..... E05B 81/80; E05B 81/82; E05B 81/86
USPC ..... 309/9.1
See application file for complete search history.

(56) References Cited

U.S. PATENT DOCUMENTS 3,631,257 A * 12/1971 Behr ..... H02J 9/061 307/130
5,225,761 A * 7/1993 Albright ..... H02J 7/1423 320/117
5,547,208 A * 8/1996 Chappell ..... E05B 77/12 180/281
6,265,851 B1 * 7/2001 Brien ..... B60L 11/005 320/137
2001/0019227 A1 * 9/2001 Girard ..... E05B 77/12 307/66
2003/0155779 A1 * 8/2003 Belmond ..... E05B 81/06 292/216
2003/0164616 A1 * 9/2003 Belmond ..... E05B 77/12 292/201

(Continued)

FOREIGN PATENT DOCUMENTS

DE 196 33 202 C1 9/1997
DE 10 2009 013650 A1 9/2010

(Continued)

OTHER PUBLICATIONS

Pecoul: FR 2874136, machine translation.*

(Continued)

*Primary Examiner* — Jared Fureman
*Assistant Examiner* — James Evans
(74) *Attorney, Agent, or Firm* — Renner, Otto, Boiselle & Sklar, LLP

(57) ABSTRACT

An electrically operable motor vehicle door lock (1) has a locking mechanism including at least one locking element (2) and/or actuating element, a motor (3) which acts on the locking element (2) and/or actuating element, and an emergency energy source (12) for emergency operation of the motor (3) in the event of failure of a main energy source (6). A switching element (8, 9) actuated by the main energy source (6) is provided. The switching element (8, 9) connects the emergency energy source (12) to the motor (3) electrically in the event of failure of the main energy source (6) to and provide for the emergency operation.

16 Claims, 2 Drawing Sheets

(56) References Cited

U.S. PATENT DOCUMENTS

| | | | | |
|---|---|---|---|---|
| 2012/0280660 | A1* | 11/2012 | Aga | B60L 11/1872 320/134 |
| 2013/0041555 | A1* | 2/2013 | Kouzuma | B60R 21/013 701/36 |
| 2015/0330116 | A1* | 11/2015 | Dente | E05B 81/86 307/10.1 |

FOREIGN PATENT DOCUMENTS

| | | | |
|---|---|---|---|
| EP | 1 130 202 | A1 | 9/2001 |
| FR | 2 874 136 | A1 | 2/2006 |
| JP | 2000-64685 | A * | 2/2000 |

OTHER PUBLICATIONS

Amano: JP 2000064685, machine translated Specification; Feb. 29, 2000.*

International Search Report and Written Opinion for corresponding Patent Application No. PCT/IB2014/001300 dated Feb. 6, 2015.

* cited by examiner

ELECTRICALLY OPERABLE MOTOR VEHICLE DOOR LOCK

FIELD OF THE INVENTION

The invention relates to an electrically operable motor vehicle door lock, having a locking mechanism including at least one latching and/or actuating element, and furthermore having a motor that operates on the latching and/or actuating element, and having at least one emergency energy source for emergency operation of the motor when the main energy source fails.

BACKGROUND

Electrically operable motor vehicle door locks are distinguished by the fact that typically a locking element, as a component of a locking lever chain, is transferred to its "unlocked" or "locked" positions with the aid of a motor. That can occur in the sense of a central locking system, as has been known and is employed in practice. In this connection, examples of such devices are described in DE 25 40 675 A1, as well as to DE 29 11 630 C2, both of which describe the beginnings of such central locking systems.

For reasons of security, in many countries today motor vehicles are driven almost exclusively in the locked state. Thus, the subject motor vehicle often is centrally locked automatically as soon as travel is initiated. The occupants are thereby protected automatically, for example, from theft attacks at traffic lights. As soon as such a vehicle becomes involved in an accident, however, the danger exists that the main energy source—this is normally the storage battery (conventionally a battery) stored in the engine compartment or passenger compartment or in the back—is destroyed, or the supply cables break off.

For this reason, for emergency operation of the motor, as exemplified by DE 10 2005 026 377 A1, a capacitor has been proposed by which the motor is supplied briefly with electric current, so that the motor vehicle door lock can be opened mechanically. In this way, passengers can leave the wrecked vehicle on their own or can be rescued by rescue personnel without difficulty.

In the prior art, the objective is being able to activate the motor vehicle door lock again after an emergency operation. To this end, the known motor vehicle door lock has an actuator to disengage mechanical emergency connecting elements. The mechanical emergency connecting elements are engaged automatically when the power supply fails. In general, the actuator can be activated by hand.

The interaction between the known main energy source and the emergency energy source or the capacitor corresponding to DE 10 2005 026 377 A1 is not free of defects, however, because in the case of emergency operation emergency connecting elements are engaged. That can result in functional problems, and in addition drives up the requisite energy need, so that flawless operation cannot be guaranteed under all circumstances.

SUMMARY OF THE INVENTION

The present invention remedies one or more of the above deficiencies of conventional motor vehicle door locks.

The present invention refines an electrically operable motor vehicle door lock in such a way that the functionality is improved and the requirement for current is reduced overall, so that, for example, flawless unlocking is possible during emergency operation with the aid of the motor.

An electrically operable motor vehicle door lock within the framework of the present invention has a switching element actuated by the main energy source, which connects the motor electrically with the emergency energy source and provides for emergency operation in the event of failure of the main energy source.

The emergency operation of the motor made available with the aid of the emergency energy source can be realized in a variety of ways. If the motor acts on a locking element and, for example, a central locking element in such a way that the latter is transferred to the positions "locked" and "unlocked," then the emergency operation corresponds to the locking element being at least "unlocked." The emergency operation of the motor designed in this case as a locking motor corresponds to an unlocking of the motor vehicle door lock according to the present invention.

Other emergency operations may be employed. For example, the electrically operable motor vehicle door lock according to the present invention may also be a so-called electric lock, which is opened with the aid of the motor. In that case the motor operates on an actuating element, such as for example a tripping lever. With the aid of the actuating element or tripping lever, a locking pawl is withdrawn from a rotary latch, so that as a result the locking mechanism comprising the locking pawl and rotary latch opens.

The emergency operation can now ensure that the motor provides for an emergency opening. In exemplary embodiments, the motor actuated with the aid of the emergency energy source applies force to the tripping lever in such a way that the latter withdraws the locking pawl from the rotary latch as described. As a result, the motor vehicle door lock is opened, and the associated motor vehicle door can be opened without difficulty by occupants located inside or by rescue personnel from outside.

In exemplary embodiments of the present invention, a switching element is provided which is actuated by the main energy source. A failure of the main energy source results in the switching element connecting the emergency energy source electrically to the motor instead of the main energy source. In this way, the switching element provides for the described emergency operation of the motor.

In exemplary embodiments, the switching element can be guided into at least two selector positions. In exemplary embodiments, the two selector positions are the positions "main energy source on/off." The two selector positions of the main energy source, "main energy source on/off," correspond to equivalent selector positions of the emergency energy source of being "emergency energy source off/on", opposite to the two selector positions of the main energy source.

Accordingly, the overall design is such that the selector position "emergency energy source off" of the emergency energy source corresponds to the selector position "main energy source on" of the main energy source. The switching element thereby ensures that when the main energy source is functioning, i.e., in the selector position "main energy source on," only the main energy source supplies the motor with the requisite electrical energy. Because in this selector position the emergency energy source is switched off, the selector position "emergency energy source off" applies to this case.

Conversely, failure of the main energy source corresponds to the selector position "main energy source off" of the switching element. At the same time, the selector position "emergency energy source on" applies here. Thus, in this case the switching element ensures that the emergency energy source is connected to the motor, so that the described emergency operation occurs. That is, the main energy source and the emergency energy source are connected oppositely to the motor to supply it with electrical energy.

If the main energy source is applied, the switching element provides for an interruption of the supply of current to the motor by the emergency energy source. Conversely, the interruption of the supply of current to the motor by the main energy source automatically results in the motor being supplied with electrical energy through the emergency energy source. This switchover occurs automatically because the switching element is actuated by the main energy source.

In exemplary embodiments, the switching element has at least one switch. In exemplary embodiments, two switches are provided, both of which are remote-controlled. The switching element may have a control circuit and a working circuit.

The main energy source and the motor are tied into the control circuit. As long as current is flowing through the control circuit and consequently the main energy source is intact, both switches are open. The two switches lead to the emergency energy source and its two poles. Consequently, the emergency energy source is then in the "off" state because both switches are open. On the other hand, if a failure of the main energy source occurs, then the switches are closed. As a consequence, both poles of the emergency energy source are connected to the motor through the two switches, now closed, and can supply the motor with the requisite electrical energy in place of the main energy source. This brings about the emergency operation.

To this end, the emergency energy source is generally connected in parallel to the main energy source. Moreover, the emergency energy source is advantageously charged electrically from the main energy source. That ensures that the emergency energy source always has the necessary stored electrical energy, so that the described emergency operation can be undertaken in case of need.

In exemplary embodiments, the main energy source and the emergency energy source are connected to a common positive connecting line, as well as each being grounded. The positive connecting line normally has a flow control valve tied in, for example, in the form of a diode. In this way the present invention ensures that the motor, as described, is supplied with electrical energy alternatively from either the main energy source or the emergency energy source.

Moreover, in exemplary embodiments, during emergency operation the motor simultaneously undergoes a reversal of direction. In normal mode, for example, and with energy being supplied with the aid of the main energy source, if the motor acts on the locking element to assume the "locked" position, then the reversal of direction connected with the emergency operation corresponds to the locking element being actuated in the sense of being "unlocked" under the action of the emergency energy source. That causes the emergency operation of the motor to work in the opposite direction to the normal operation.

Comparable operation applies in the case where the motor is employed alternatively in the sense of being "electrically open." In this case, for example, the normal mode corresponds to the actuating element being at rest or the locking pawl not being acted upon, while on the other hand the emergency operation provides for an electrical opening process.

The motor as a whole, and as already described, is tied into the control circuit of the switching element. The main energy source is also found in the aforementioned control circuit of the switching element. In contrast, the emergency energy source is situated in the working circuit of the switching element. In this connection, both connection ends of the emergency energy source are connected to the associated switch of the switching element. As long as the main energy source is working and the normal operation is observed, the applicable switches are open, so that the emergency energy source with its two DC poles (plus pole and minus pole) is separated from the motor. However, if a failure of the main energy source occurs, the current in the control circuit collapses. As a result, both switches in the working circuit are closed, so that the emergency energy source then provides directly and automatically, well as without delay, for the necessary supply of energy to the motor.

When switching over from the main energy source to the emergency energy source with the aid of the switching element as described, in exemplary embodiments there is also a reversal of direction of the electric current flowing through the motor. This reversal of direction automatically also results in the motor or electric motor likewise changing its direction, and the motor vehicle door lock being transferred, for example, from the "locked" state to the "unlocked" functional state, as described earlier.

In general, the two switches of the switching element are operated synchronously. Furthermore, the two switches of the switching element correspond to the selector positions already described initially, "main energy source on, emergency energy source off" and "main energy source off, emergency energy source on." To be able to implement this especially simply and economically, the switching element may be, in exemplary embodiments, a relay, i.e., an electromagnetically operated remote-controlled switch. Alternatively, a semiconductor relay may also be employed at this location. In general, however, the switching element is what is known as a plug-in relay, as often utilized in motor vehicles.

As a result, an electrically operable motor vehicle door lock is made available, which operates especially reliably and at the same time has a mechanically simple and cost-effective construction and low power consumption. The motor or electric motor of the electrically operable motor vehicle door lock is supplied with the requisite electrical energy by either the main energy source or the emergency energy source. The switchover occurs quickly and automatically, as soon as the main energy source has failed.

In addition, the design as a whole is such that the energy content of the emergency energy source, which is typically a capacitor, is in any case adequate to be able to carry out the described emergency operation reliably. The locking element is transferred from its previously assumed "locked" position at least to the "unlocked" position. That enables the associated motor vehicle door lock according to the present invention to be opened without problem, and both from inside and from outside.

Further features of the invention will become apparent from the following detailed description when considered in conjunction with the drawings.

BRIEF DESCRIPTION OF THE DRAWINGS

The invention will now be explained in greater detail on the basis of drawings, which depict exemplary embodiments. The figures show the following.

DETAILED DESCRIPTION

Figure 1:
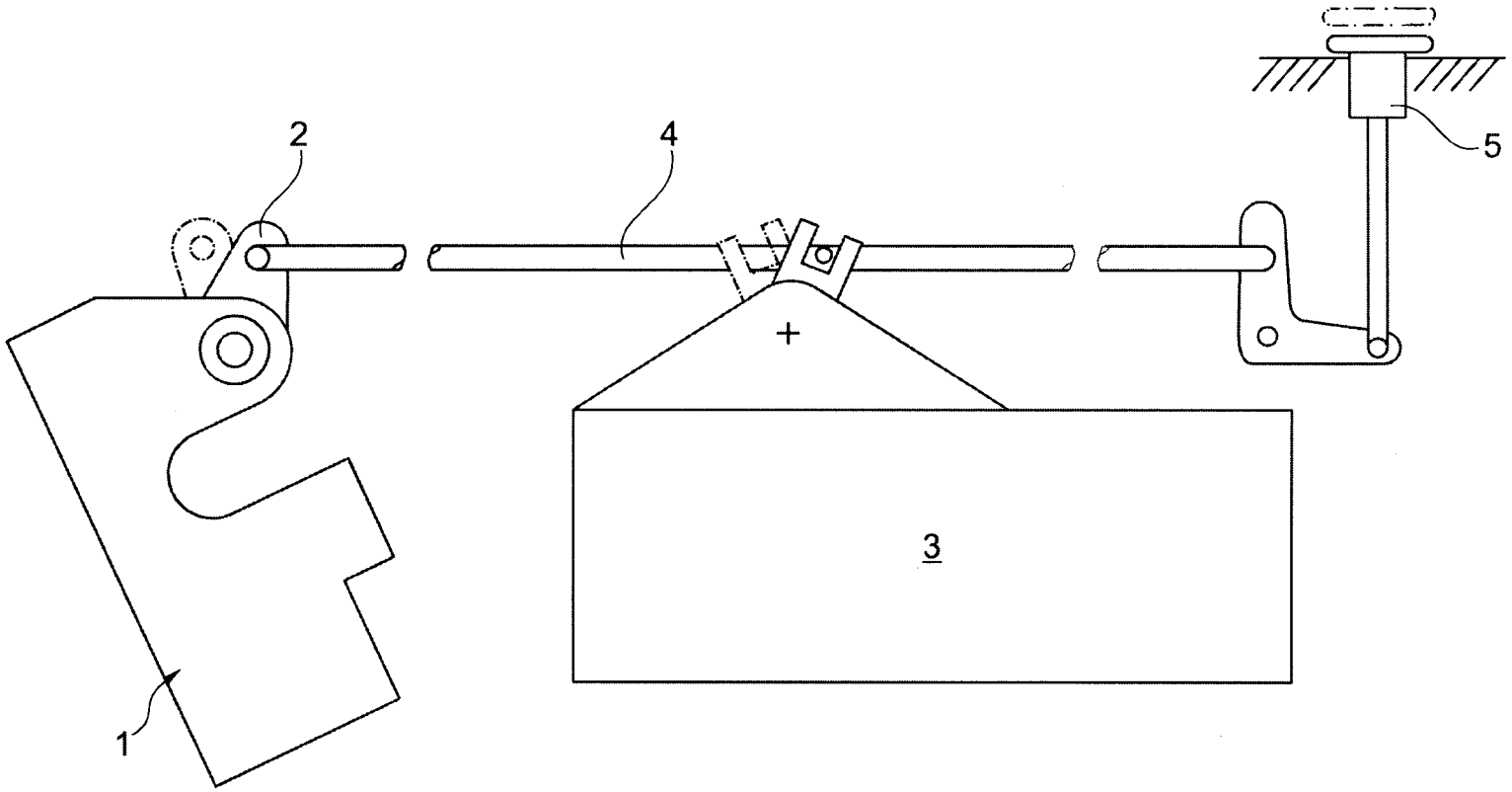
FIG. 1 an electrically operable motor vehicle door lock according to the present invention in a basic schematic depiction, and FIG. 2 the corresponding electrical circuit for supplying energy to the motor.

FIG. 1 depicts an electrically operable motor vehicle door lock 1. The motor vehicle door lock 1 has, for example, a locking element 2, which in exemplary embodiments is led to outside of the motor vehicle door lock 1, merely to clarify the principle of operation. The locking element, or the locking lever 2 which is realized at this location, is acted on by a motor 3, with an actuating element 4 interposed in this example, which in the present exemplary embodiment is an actuating rod 4.

Furthermore, the actuating rod 4 is coupled mechanically with an inside locking knob 5. The solid-line position in FIG. 1 corresponds to the "locked" position of the motor vehicle door lock, assumed in the present exemplary embodiment in normal operation. In contrast, the dot-dash position of the actuating rod 4 and also of the locking lever 2, belongs to the "unlocked" position of the motor vehicle door lock 1. The locking knob 5 then assumes a raised position in comparison.

In normal operation, the motor 3 acting on the locking element 2 is supplied with the requisite electrical energy with the aid of a main energy source. The normal operation and the "locked" position of the locking element 2, according to FIG. 1 in the example, correspond to a switch 7 in the circuit diagram according to FIG. 2 being closed, as the solid-line position makes clear. An electric current then flows starting from the main energy source 6 or its indicated positive pole through the switch 7, another switch 8, through the motor 3, and by way of an additional switch 8 and a junction point 10, finally to the ground 11. The main energy source 6 is the battery located in the motor vehicle, or the storage battery there. The switch 7 is basically an optional switch.

The two switches 8, which are closed in normal operation when energy is supplied to the motor 3 by the main energy source 6, belong to a switching element 8, 9 which will be explained in greater detail below.

Besides the main energy source 6, an emergency energy source 12 is also realized. In exemplary embodiments, the emergency energy source 12 is a capacitor, although the emergency energy source 12 is not limited to a capacitor. In the event that the main energy source 6 is destroyed, for example in an accident, or one or both supply lines of the main energy source 6 to the motor 3 break, the motor 3 is supplied with the requisite electrical energy with the aid of the emergency energy source 12, so that the motor 3 is at least able to perform at least an emergency operation described in greater detail below.

The emergency operation is designed in exemplary embodiments so that the motor 3, corresponding to the depiction in FIG. 1, guides the locking element or locking lever 2 to the dot-dashed "unlocked" position. The same then holds for the inside locking knob 5, and consequently for the motor vehicle door lock 1 as a whole. That is, in an emergency operation the motor vehicle door lock 1 is transferred to its functional position "unlocked" with the aid of emergency energy source 12, and consequently can be opened without problem both from inside and from outside the motor vehicle.

Thus, the supply of energy to the motor 3 can be switched over automatically and without delay from the main energy source 6 to the emergency energy source 12 in the case of such a crash or in an accident, according to operation of the switching element 8, 9, which is actuated by the main energy source 6. The switching element 8, 9 connects the emergency source 12 to the motor 3 electrically in the event of failure of the main energy source 6. The switching element 8, 9 thereby provides simultaneously for the described emergency operation.

To this end, the switching element 8, 9 can be guided into at least two selector positions. These two selector positions correspond on the one hand to the functional position "main energy source 6 on; emergency energy source 12 off," and on the other hand "main energy source 6 off; emergency energy source 12 on."

It can be seen that the emergency energy source 12 is switched in parallel to the main energy source 6. Furthermore, the emergency energy source 12 is supplied with electrical energy from the main energy source 6. To this end, a positive line 13 is supplied on the one hand, and on the other hand a ground line 14 is supplied which is connected to the ground 11. That is, the main energy source 6 and the emergency energy source 12 are connected on the one hand to the common positive connecting line 13, as well as both to ground 11 on the other hand through the common ground line 14.

Figure 2:
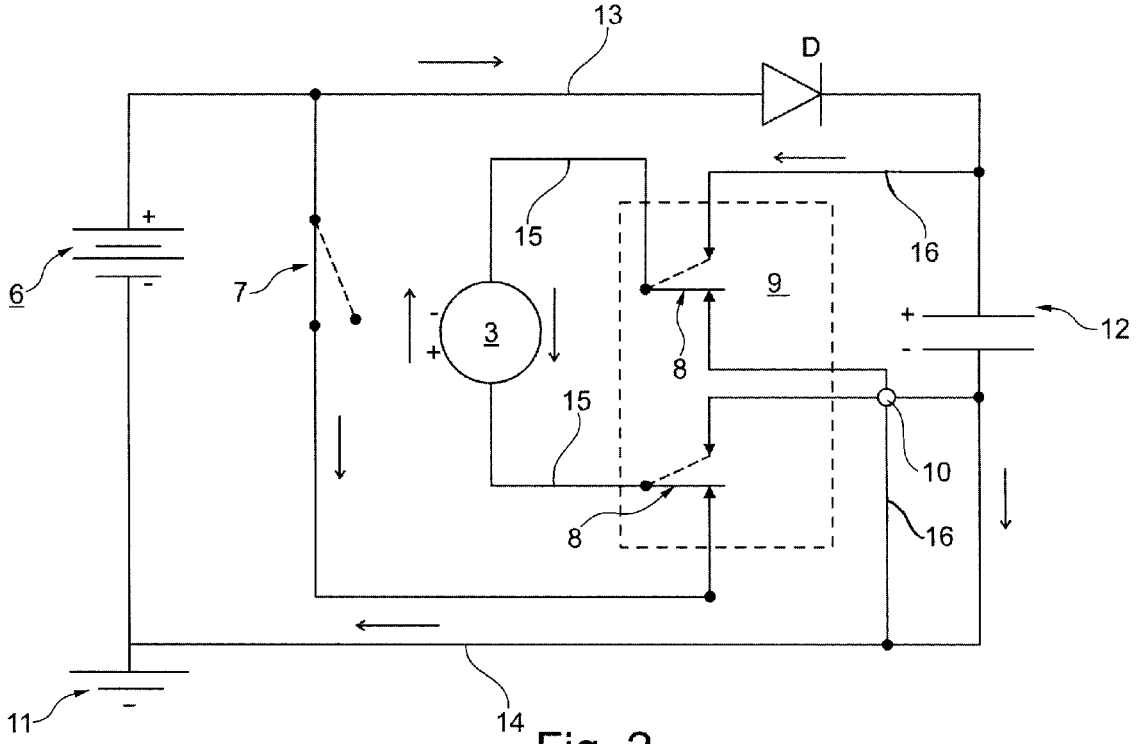

In the exemplary embodiment according to FIG. 2, a flow control valve D is tied into positive connecting line 13. In the exemplary embodiment of FIG. 2, the flow control valve is a diode D, which may be a semiconductor diode. The diode D ensures that the current coming from the main energy source 6 can flow on the one hand to charge the emergency energy source 12 and on the other hand to supply the motor 3, only in the indicated arrow direction in each case, and that a flow of current in the opposite direction is not possible. As soon as the capacitor or the emergency energy source 12 is completely charged, it acts as an open switch as a result of the DC voltage present; that is, no additional current is able to flow through the emergency energy source 12.

The switching element 8, 9 is equipped with a control circuit 15 on the input side and a working circuit 16 on the output side. It can be seen that the emergency energy source 12 is situated in the working circuit 16. In contrast, the motor 3, and also the main energy source 6 are located in the control circuit 15 of the switching element 8, 9.

The two poles of the emergency energy source 12 are connected to the control circuit 15 through the working circuit 16 and the two switches 8, provided that the two switches 8 are in their dashed (open) position. That is, in the open position both connection ends of the emergency energy source 12 are connected to the corresponding switches 8 of the switching element 8, 9. Furthermore, both switches 8 of the switching element 8, 9 are actuated synchronously, and reflect the two basic selector positions of the switching element 8, 9 mentioned previously, i.e., "main energy source 6 on; emergency energy source 12 off" on the one hand, and "main energy source 6 off; emergency energy source 12 on" on the other hand.

The switching element 8, 9 is an electromagnetically operated remote-controlled switch, such as for example a relay 8, 9. In the exemplary embodiment of FIG. 2, the relay 8, 9 is made up of the two synchronously actuated switches 8 on the one hand and a coil 9 shown as outline by the dashed line. In normal operation and with the main energy source 6 intact, the two switches 8 are closed, corresponding to the solid-line position in FIG. 2.

The electric current coming from the positive pole of the main energy source 6 flows through the coil 9. The current flows from the positive pole of the main energy source 6 through the closed switch 7, the switch 8, through the motor 3 and additional switch 8 to the junction 10 and on to the ground 11. The coil 9, through which current flows simultaneously and in parallel here, ensures in this connection that the two switches 8 are attracted by the magnetic field of the coil 9 and assume the closed position corresponding to the solid-line position in FIG. 2. The switching element 8, 9 is consequently in the selector position "main energy source 6 on; emergency energy source 12 off," because the emergency energy source 12 in the working circuit 16 is uncoupled from the motor 3 by the respective closed switch 8.

If instead a failure of the main energy source 6 or a break in the positive connecting line 13 or the ground line 14 occurs, current is no longer flowing through the motor 3—at least for the short term. The same is true of the coil 9.

However, the locking element 2 maintains its "locked" position in the example, due to mass inertia and/or friction in motor 3. In consequence of this the two switches 8 are no longer attracted by the coil 9, and move to the dashed (open) position corresponding to FIG. 2, for example with spring support.

The emergency energy source 12 is now connected to the motor 3 through the switch 8, which is in the dashed position. For emergency operation a current indicated in FIG. 2, coming from the positive pole of the emergency energy source 12, can flow through the upper switch 8, the motor 3 and the additional switch 8 to the junction point 10, and then to the ground 11. In this emergency operation a reversal of direction of the electric current takes place, in comparison to normal operation. In consequence, the motor 3 is acted on in its opposite direction.

If normal operation functioning with main energy source 6 corresponds, for example, to the motor 3 acting on the locking element 2 in the sense of "locked" corresponding to the depiction according to FIG. 1, then the emergency operation corresponds to the opposite action on the locking element 2. This corresponds to the "unlocked" position, as indicated by the dash-dotted line in FIG. 2.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electrically operable motor vehicle door lock comprising:

a locking mechanism including at least one of a locking element and an actuating element, a motor that acts on the locking mechanism, at least one emergency energy source for emergency operation of the motor in the event of failure of a main energy source, and a switching element actuated by the main energy source, which further connects the emergency energy source with the motor electrically in the event of failure of the main energy source for emergency operation, wherein the switching element has at least two selector positions comprising main energy source on and main energy source off, wherein the two selector positions main energy source on/off of the switching element correspond to matching selector positions emergency energy source off and emergency energy source on, and wherein the emergency energy source is switchable in parallel to the main energy source to be charged electrically by the main energy source.

2. The motor vehicle door lock according to claim 1, wherein the main energy source and the emergency energy source are connected to a common positive connecting line and to a ground.

3. The motor vehicle door lock according to claim 2, wherein the positive connecting line has a flow control valve.

4. The motor vehicle door lock according to claim 3, wherein the flow control valve is a semiconductor diode.

5. The motor vehicle door lock according to claim 1, wherein the motor is tied into a control circuit of the switching element.

6. The motor vehicle door lock according to claim 1, wherein the emergency energy source is situated in a working circuit of the switching element.

7. The motor vehicle door lock according to claim 1, wherein both connection ends of the emergency energy source are connected to associated switches of the switching element.

8. The motor vehicle door lock according to claim 7, wherein the two switches of the switching element are actuated synchronously and correspond to the two selector positions.

9. An electrically operable motor vehicle door lock comprising:

a locking mechanism including at least one of a locking element and an actuating element, a motor that acts on the locking mechanism, at least one emergency energy source for emergency operation of the motor in the event of failure of a main energy source, and a switching element actuated by the main energy source, which further connects the emergency energy source with the motor electrically in the event of failure of the main energy source for emergency operation, wherein the switching element has at least two selector positions comprising main energy source on and main energy source off, and wherein both connection ends of the emergency energy source are connected to associated switches of the switching element.

10. The motor vehicle door lock according to claim 9, wherein the emergency energy source is switched in parallel to the main energy source and is charged electrically by the main energy source.

11. The motor vehicle door lock according to claim 9, wherein the main energy source and the emergency energy source are connected to a common positive connecting line and to a ground.

12. The motor vehicle door lock according to claim 11, wherein the positive connecting line has a flow control valve.

13. The motor vehicle door lock according to claim 12, wherein the flow control valve is a semiconductor diode.

14. The motor vehicle door lock according to claim 9, wherein the motor is tied into a control circuit of the switching element.

15. The motor vehicle door lock according to claim 9, wherein the emergency energy source is situated in a working circuit of the switching element.

16. The motor vehicle door lock according to claim 9, wherein the two switches of the switching element are actuated synchronously and correspond to the two selector positions.

* * * * *